US005792310A

United States Patent [19]

Thompson et al.

[11] Patent Number: 5,792,310

[45] Date of Patent: Aug. 11, 1998

[54] ROLL-ON BOX SEALING HAND APPLICATOR

[75] Inventors: Craig D. Thompson; Robert E. Davenport, Jr., both of Inver Grove Heights, Minn.

[73] Assignee: Minnesota Mining and Manufacturing Company, St. Paul, Minn.

[21] Appl. No.: 114,777

[22] Filed: Aug. 31, 1993

[51] Int. Cl.[6] ..... B32B 31/00

[52] U.S. Cl. ..... 156/523; 156/527; 156/577; 156/579

[58] Field of Search ..... 156/523, 527, 156/526, 574, 577, 579

[56] References Cited

U.S. PATENT DOCUMENTS

| | | | |
|---|---|---|---|
| 3,051,223 | 8/1962 | Waltz | 156/527 |
| 3,085,727 | 4/1963 | Waltz | 156/527 X |
| 3,109,570 | 11/1963 | Maddalena | 225/66 |
| 3,149,764 | 9/1964 | Waltz | 225/57 |
| 3,753,839 | 8/1973 | Funke et al. | 156/527 X |
| 5,164,038 | 11/1992 | Sundqvist | 156/577 |
| 5,236,540 | 8/1993 | Shi | 156/527 X |

FOREIGN PATENT DOCUMENTS

| | | | |
|---|---|---|---|
| 0 104 989 A2 | 9/1983 | European Pat. Off. | B65H 35/07 |
| 2173453 | 5/1973 | France | B65H 35/00 |

OTHER PUBLICATIONS

Scotch H-131 One-Hand Filament Tape Applicator, Model 27300, 3M Brochure No. 34-7004-7176-5(J32.25)R2.

Scotch H-140 Filament Tape Pallet Unitizing Dispenser, 3M Brochure No. 34-7004-7183-1(E42.15)R.

Scotch H-120 Filament Tape Hand Dispenser, 3M Brochure No. 34-7004-7082-5(F932.5)R2.

Scotch H-130 Filament Tape Hand Dispenser, 3M Brochure No. 34-7004-7060-1(H43.3)R2.

Scotch Filament Tape Hand Dispensers, H-10, 3M Brochures No. 34-7004-7320-9(33.5)R1.

Scotch H-133 One-Hand Filament Tape Applicator, Model 27800, 3M Brochure No. 34-7004-7232-6(G81.8)R1.

*Primary Examiner*—James Engel

*Attorney, Agent, or Firm*—Michaele A. Hakamaki

[57] ABSTRACT

A hand box sealing tape applicator for dispensing and applying a length of tape from a roll of tape to an object includes a frame comprising a support portion and an angled nose portion. A tape roll support means is provided on the support portion of the frame for rotatably supporting a roll of tape thereon and for providing a gripping surface for a user to hold and manipulate the hand tape applicator. Furthermore, an applicator member, preferably comprising an application roller, is operatively supported by the angled nose portion of the frame so that a space will be defined between the applicator member and a roll of tape when it is supported on the roll support means, wherein the space is positioned and of sufficient size so that when a roll of tape is supported on the roll support means and the roll of tape is held above one surface of an object, the application member can be positioned against another surface of the object that is perpendicular to the first surface with a corner of the object within the space. A guide means, preferably defined by at least one guide roller, is also provided for defining a tape guide path from the roll support means to the applicator member, and a cutting means is positioned adjacent to the applicator member for cutting the length of tape from the roll.

1 Claim, 3 Drawing Sheets

ROLL-ON BOX SEALING HAND APPLICATOR

TECHNICAL FIELD

The present invention relates generally to a hand held tape dispenser. More specifically, the present invention is a hand held box sealing tape dispenser which is designed to accommodate the direct hand application of such box sealing tape to a box or carton with greater ease and control.

BACKGROUND OF THE INVENTION

Tape dispensing apparatuses are typically designed to accommodate the specific type of tape to be dispensed, the object to which the tape is to be adhered to, the frequency of application, and other general use and environmental considerations relating to the specific manner and location of the application for the specific use. Such tape dispensing apparatuses include those which are automatic and apply adhesive tape to objects or a moving web in a production line, manual dispensers for tape application either in a production line setting or on as needed basis, and combinations thereof. Within manual tape dispensers, hand dispensers have been developed for a variety of tapes for dispensing and/or applying such tapes as needed.

Hand held dispensers typically include a support or hub for rotatably supporting a roll of adhesive tape on the dispenser, some tape guide means for guiding the tape from the roll to a dispensing point on the dispenser, and a blade or the like for cutting the dispensed tape at a desired length. Moreover, hand held tape applicators have been developed which not only dispense tape in the same sense as the dispensers just previously described but also include an application member which rides against the tape backing to apply the tape on the surface of the object being taped.

A disadvantage of hand dispensers that do not have an applicator means is that they often require the use of two hands for tape application. Typically, the user of such a hand dispenser would grasp the dispenser and would use their other hand to apply and press the tape onto the object. In the case of a box or carton sealing technique, to which the present invention is specifically directed, the user would pull out a desired length of tape from the dispenser and apply it to a front surface of the box. Then, the user would pull the dispenser across the box top, over the center seam, while applying hand pressure with the opposite hand to press or buff the tape down. Lastly, the user would continue the tape down the backside of the box a desired length, would cut the tape, and would buff that portion down by hand.

An example of a box sealing tape hand dispenser is that available from Minnesota Mining and Manufacturing Company of St. Paul, Minn. as product No. H-122 Hand Dispenser. Such a dispenser is designed with the general features described above and is used in the manner of sealing a box or carton as described just above. The H-122 Hand Dispenser, however, is advantageous in that it provides a compact design and is further provided with a brake that allows the user to control the tape tension during dispensing and at cut-off. Again, the disadvantage is that application is a two hand process.

An example of a box sealing tape applicator is the H-171 Roll-On Dispenser also available from Minnesota Mining and Manufacturing Company of St. Paul, Minn. Such a dispenser permits the dispensing of box sealing tape directly from the roll onto the box or carton. An applicator roller is specifically provided for applying and buffing the tape onto the surface of the box or carton. A disadvantage of such applicators is that such applicators are large relative to the hand dispensers and are therefor not as portable. Moreover, the applicators of the H-171 Roll-On Dispenser variety are further disadvantageous in that the tape tension can not be user controlled during application, although some models allow for tension adjustment within the tape drum by an internal tensioning mechanism, and the user can not brake the tape roll to prevent accidental dispensing during cut-off.

Furthermore, the prior art dispensers and applicators require substantial manual manipulation and reorientation of the devices as the tape is applied in the typical fashion of a C-clip, that is on a front surface, over a top or bottom surface, and down a back surface, for sealing a box or carton. In the case of a tape applicator, the unit must be substantially reoriented or the box must be repositioned as the tape is applied on such a front surface, top or bottom surface, and back surface. With a dispenser, the users second hand is required to adhere the tape on the respective surfaces.

SUMMARY OF THE PRESENT INVENTION

The present invention overcomes the shortcomings and disadvantages of the prior art dispensers and applicators by providing a hand box sealing tape applicator which is compact, portable and controllable in the sense of prior art hand dispensers, but which includes an application means for dispensing and applying the box sealing tape directly to the surface of a box or carton. Moreover, the geometry and design of the present hand box sealing tape applicator minimizes user reorientation of the device even as the device sequentially applies box sealing tape in the manner of a C-clip, described above. The overall comfort and ease of tape application are increased by the present invention.

The above mentioned advantages associated with the present invention are achieved by a hand box sealing tape applicator for dispensing and applying a length of tape from a roll of tape to an object that includes a frame comprising a support portion and an angled nose portion. A tape roll support means is provided on the support portion of the frame for rotatably supporting a roll of tape thereon and for providing a gripping surface for a user to hold and manipulate the hand tape applicator. Furthermore, an applicator member, preferably comprising an application roller, is operatively supported by the angled nose portion of the frame so that a space will be defined between the applicator member and a roll of tape when it is supported on the roll support means, wherein the space is positioned and of sufficient size so that when a roll of tape is supported on the roll support means and the roll of tape is held above one surface of an object, the application member can be positioned against another surface of the object that is perpendicular to the first surface with a corner of the object within the space. A guide means, preferably defined by at least one guide roller, is also provided for defining a tape guide path from the roll support means to the applicator member, and a cutting means is positioned adjacent to the applicator member for cutting the length of tape from the roll after it has been dispensed and applied to an object.

Preferably, the hand applicator further includes a brake element rotatably supported on the frame having a brake surface for engaging the roll of tape when it is provided on the roll support means for permitting a user to control the tape tension during application and to stop the tape during cutting.

DETAILED DESCRIPTION

Figure 1:
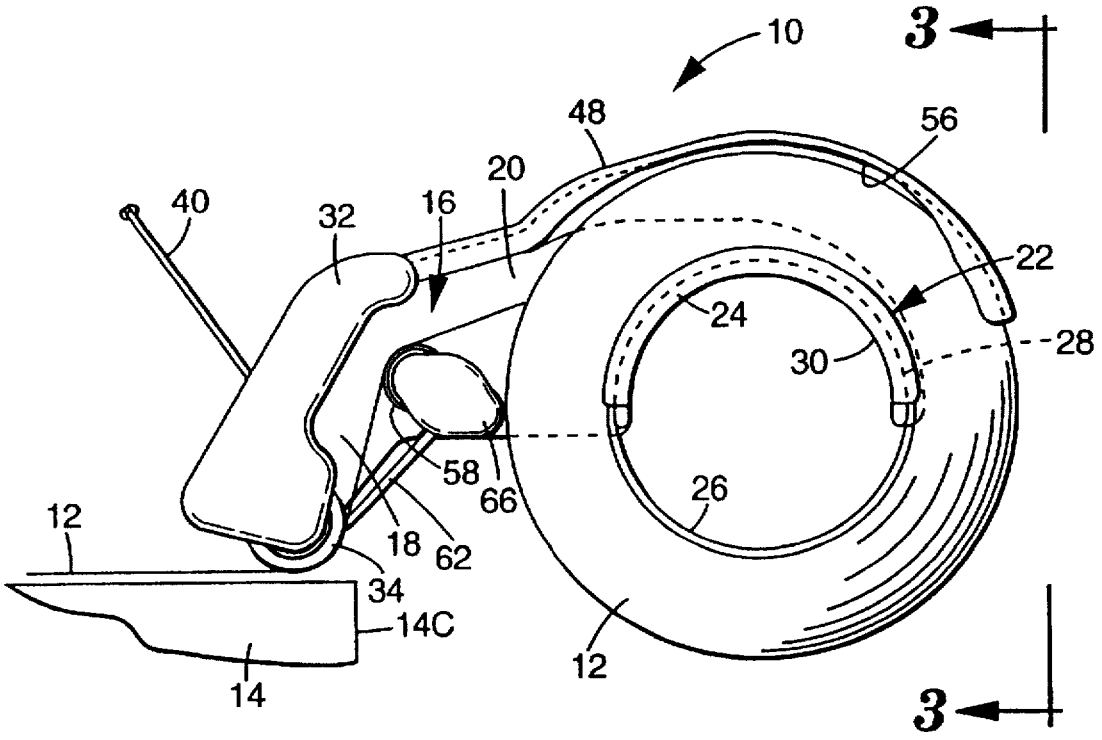
FIG. 1 is a side elevational view of a hand tape applicator in accordance with the present invention further showing a roll of tape supported within the applicator and the tape path to the application point.

With reference now to the Figures and initially to FIG. 1, wherein like components are labelled with like numbers throughout the several Figures, a hand box sealing tape applicator 10 is illustrated in combination with a roll of tape 12. The tape 12 is shown threaded through the hand tape applicator 10 and in the process of being applied to an upper surface of a box 14. It is understood that the subject hand tape applicator can apply a variety of types of tape to any number of types of objects. In accordance with the preferred embodiment, the hand tape applicator 10 is specifically designed for applying box sealing tape to a box for sealing the box flaps as is conventionally known.

The hand tape applicator 10 includes a side frame 16. The side frame 16 is basically divided into a nose portion 18 and a support portion 20. From the support portion 20, a hub 22 is provided for supporting the tape roll 12 thereon. More specifically, the hub 22 preferably comprises an arc portion of a circle having a diameter slightly smaller than the standard diameter of the core of the tape roll 12 which is to be supported thereon. Moreover, a flange 24 is provided extending from the hub 22 to help keep the tape roll 12 on the hub 22 after it is inserted thereon. In order to facilitate the loading of the tape roll onto the hub 22, the hub 22 and flange 24 are preferably constructed of a sufficiently resilient material so that the core of the tape roll 12 can be forced over the flange 24 and then held in place by the flange 24 after the core is passed over the flange 24 and it snaps back in place. It may be desirable to add slots or the like within the hub 22 and/or the flange 24 to permit such flexibility and easy loading and removal of the tape rolls 12. In any case, the internal surface 26 of the tape core of tape 12 is facilitated to ride on the external surface 28 of hub 22 so that the roll of tape 12 is freely rotatably supported on the side frame 16 by the hub 22.

It is understood that the hub 22 need not be provided as an arc portion, but could be a complete circle, or another different shape. For example, the hub may be a portion of a flat sided polygon so long as the tape core can be supported to rotate thereon. An arc portion or circle is preferred because of a smoother braking function, as will be more fully described below.

The hub 22 further provides by its internal surface 30 a gripping portion which the user grabs by hand for holding the hand tape applicator 10 and applying the tape 12, as will be more fully described below.

At the nose portion 18 of the side frame 16, a spaced side element 32 is provided for supporting with the nose portion 18 of the side frame 16 an application roller 34. More specifically, the side element 32 is connected to the nose portion 18 by a plurality of supports 36, see FIG. 4, which extend between and define the space between the nose portion 18 and the side element 32. The supports 36 can be integrally made with either the side frame 16 or the side element 32 or can be conventionally connected to or adhered to both the nose portion 18 and the side element 32. Moreover, if plastic materials are used for the supports 36 as well as the side frame 16 and side element 32, conventional welding techniques can be utilized.

The application roller 34 is supported between the nose portion 18 and the side frame 16 and the side element 32 so as to be freely rotatable thereto. More specifically, the application roller 34 may be supported on a fixed axle 37 that is mounted, like supports 36, between the nose portion 18 and the side element 32. Thus, the roller 34 can rotate on the fixed axle 37 by way of complimentary bearing surfaces between the application roller 34 and the fixed axle 37. Otherwise, the application roller 34 may have axle portions extending from its longitudinal ends which ride on complimentary bearing surfaces (not shown) provided within the opposing sides of both the nose portion 18 and the side element 32. In any case, the application roller 34 is preferably freely rotatably supported.

Figure 4:
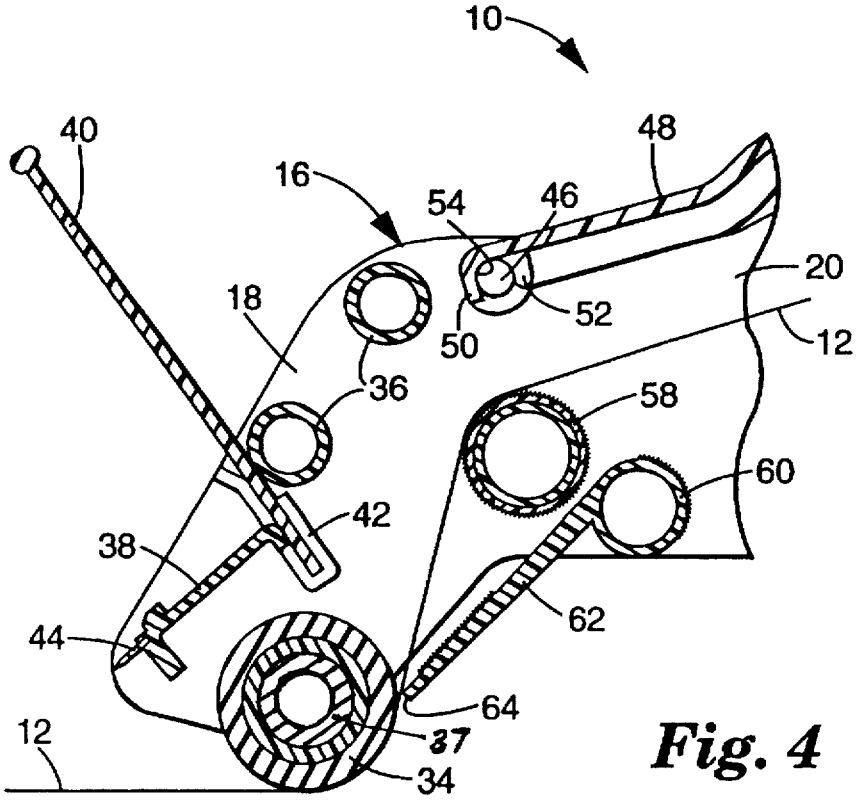
FIG. 4 is a cross-sectional view of the nose portion of the hand tape applicator of FIG. 1 taken along line 4—4 in FIG. 3.

Continuing with reference to FIG. 4, a cutting element mount 38 and a wiper 40 are also supported between the nose portion 18 of the side frame 16 and the side element 32. Specifically, the wiper 40 preferably fits within a receiver or groove 42 provided within the nose portion 18 and a similar receiver or groove (not shown) provided within the inner opposed side wall of the side element 32. Moreover, the wiper 40 may be frictionally held in place, or may be snap-fit, adhered, welded or otherwise fixed therein. The wiper 40 preferably comprises a flexible material which allows it to be used to press against the tape 12 as it is applied in certain orientations for pressing or buffing the tape 12 against the surface of an object, as will be more fully described below. Suitable materials include, for example, acetal, polypropylene, polyethylene and thermoplastic elastomeric materials including styrenic block copolymers, polyolefin blends, elastomeric alloys, thermoplastic polyurethanes, thermoplastic polyesters and thermoplastic polyamides.

Figure 2:
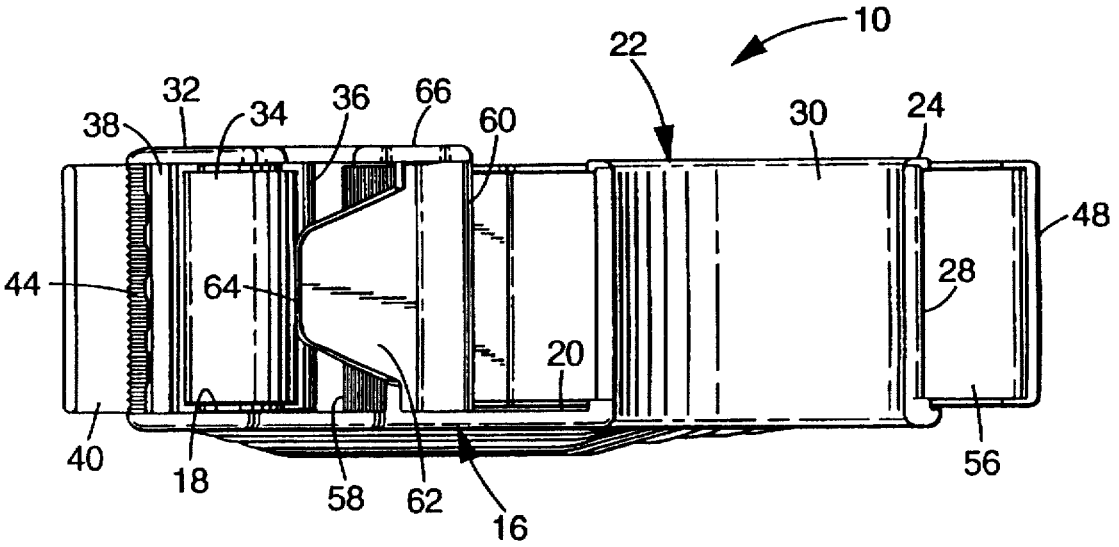
FIG. 2 is a bottom view of the hand tape applicator of FIG. 1 with the roll of tape removed.
Figure 3:
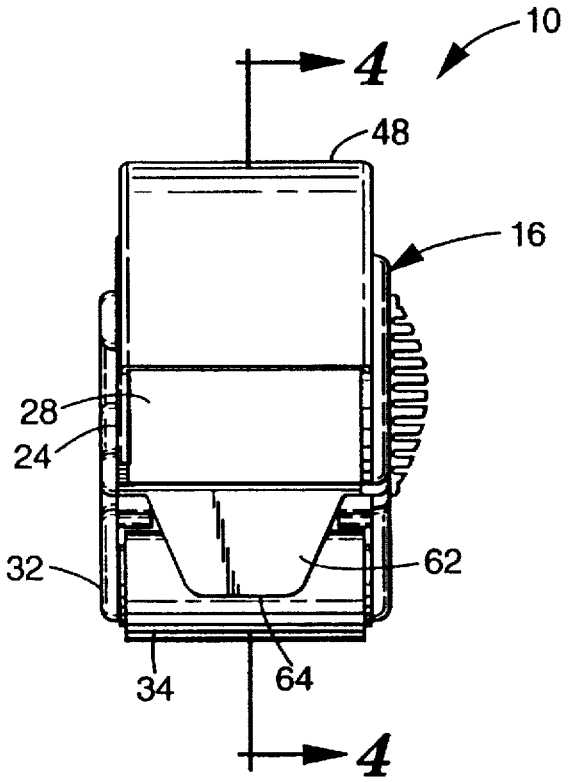
FIG. 3 is a back elevational view of the hand tape applicator of FIG. 1 taken from line 3—3 in FIG. 1 with the tape removed.

The cutting element mount 38 can be formed integrally with either the side frame 16 or side element 32 or can be conventionally fixed to both the nose portion 18 of the side frame 16 and the side element 32 by adhesive, welding, mechanical connectors, or the like. Moreover, the cutting element mount 38 preferably includes a blade 44 for cutting the tape 12 after it is applied. The blade 44 may be a straight edge, or a serrated edge and may be provided straight across the front of the hand tape applicator 10, as shown in FIG. 2, or may be provided at an angle. The cutting edge of the blade 44 should preferably extend to the forwardmost edges of the nose portion 18 of the side frame 16 and the side element 32 so that tape 12 can be easily cut during that operation, which will be more fully described below.

Yet another element supported between the nose portion 18 of the side frame 16 and the side element 32 is a rotatable connection for supporting a brake element 48. Preferably, a short pin 46 extends inwardly from both of the inside opposed surfaces of the side frame 16 and the side element 32 (not shown) to be received within eyelets 52 (only one shown) provided at the side edges of the forward portion of the brake element 48. The pin 46 can be made integral with or conventionally adhered to, welded, or otherwise attached to the side frame 16 and the side element 32. Other rotatable connection techniques could be easily utilized, such as using an axle that extends from side to side with a groove provided on the brake element to be rotatably connected thereto by a snap fit or other mechanical connector.

As can be seen in FIGS. 1 and 2, the brake element 48 includes an internal brake surface 56 for riding against the external surface of the tape roll 12. Since the brake element 48 is pivotally mounted to the side frame 16, as described above, the brake surface 56 can ride against the external surface of the tape roll 12 throughout the application of the entire tape roll 12 as its diameter is reduced toward its core at hub 22. The user operates the brake by squeezing the brake element 48 against the external surface of the tape roll 12 which works with the action of the external surface 28 of hub 22 and the interior surface 26 of the tape core of tape 12. The friction between each of these surfaces can be used by the operator to control tension during application of tape 12 to an object, such as box 14, and can be used to completely stop the dispensing of tape 12 from its roll during the cutting operation, as will be described below.

Referring again to FIG. 4, an idler roller 58 is also rotatably supported from the side frame 16 roughly at the transition between the nose portion 18 and support portion 20 thereof. Preferably, the surface of the idler roller 58 is grooved or knurled to lessen its affinity to the adhesive of the tape 12. The idler roller 58 defines the guide path for the tape 12 from the roll to the application roller 34. Moreover, the tape path is defined significantly above a line connecting the axis of the roll 12 to the axis of the application roller 34, the reason for which will be more apparent from the description of the geometry of the subject device and the operation thereof below.

Also extending from the side frame 16 adjacent to the idler roller 58 is a further support 60 which is preferably integrally provided with a tape holder 62 which extends forwardly toward the application roller 34. More specifically, as the tape holder 62 extends forwardly, it is preferably decreased in width, see FIG. 2, and defines a nip between the roller 34 and the forwardmost edge 64 thereof through which the tape 12 passes, see FIG. 4. The purpose of this nip is to substantially prevent the tape 12 from moving backward along its tape guide path, and to ensure that the tape 12 is held against the application roller 34 so that it is properly presented for each successive application of the tape 12.

The idler roller 58 and the support 60 are also preferably connected together at their distal ends by a cap 66, see FIG. 1. The cap 66 provides additional support to the idler roller 58 from the support 60 and provides a bearing surface (not shown) for permitting the idler roller 58 to rotate freely. The idler roller 58 may be supported on a fixed shaft mounted to the side frame 16 and the cap 66, or may include axle portions at the longitudinal ends thereof for riding in bearing surfaces (not shown) in both the cap 66 and the side frame 16. If a fixed shaft is used connected with the side frame 16, the shaft may be either integrally formed with the side frame 16 and of the same material, or may be made separately from metal, plastic or other depending on the strength characteristics required. In any case, the support 60 and end cap 66 provide greater strength to the supporting of the idler roller 58.

The hand tape applicator 10 has been specifically designed with a geometry to improve user comfort and to provide easier tape application which minimizes user reorientation of the hand tape applicator 10 as it applies tape to an object such as a box 14. Specifically, the nose portion 18 of the side frame 16 is bent downwardly at an angle so that the application roller 34 is spaced sufficiently downwardly from that same line. Moreover, the tape guide path defined by the idler roller 58 and the application roller 34 is substantially above a line connecting the axis of the tape roll 12 to that of the application roller 34. The result is that a space is defined between the application roller 34 and the roll of tape 12 when loaded on the hand tape applicator 10 which will facilitate tape application to a box 14 as will be described below.

Before dealing with the specific operation of the subject hand tape applicator 10, it is important to understand that the subject hand tape applicator 10 is specifically designed with a geometry to facilitate the application of a C-clip of box sealing tape to a box or carton 14. A typical box construction includes upper and lower (or opposite sides) flaps which must be sealed together to close the box 14 and preserve the integrity of whatever product is provided within the box 14. As a specific example, the box 14 shown in FIG. 5 includes a front surface 14A, a top surface 14B and a rear surface 14C. The upper surface 14B comprises a pair of flaps which form a seam along the top surface 14B of the box 14 over which the tape 12 is to be applied. A C-clip of tape includes a portion of tape 12 applied to the top of the vertical front surface 14A, a horizontal length of tape covering the seam defined by the flaps on surface 14B, and another vertical portion of tape extending partially down the rear wall 14C.

Figure 5:
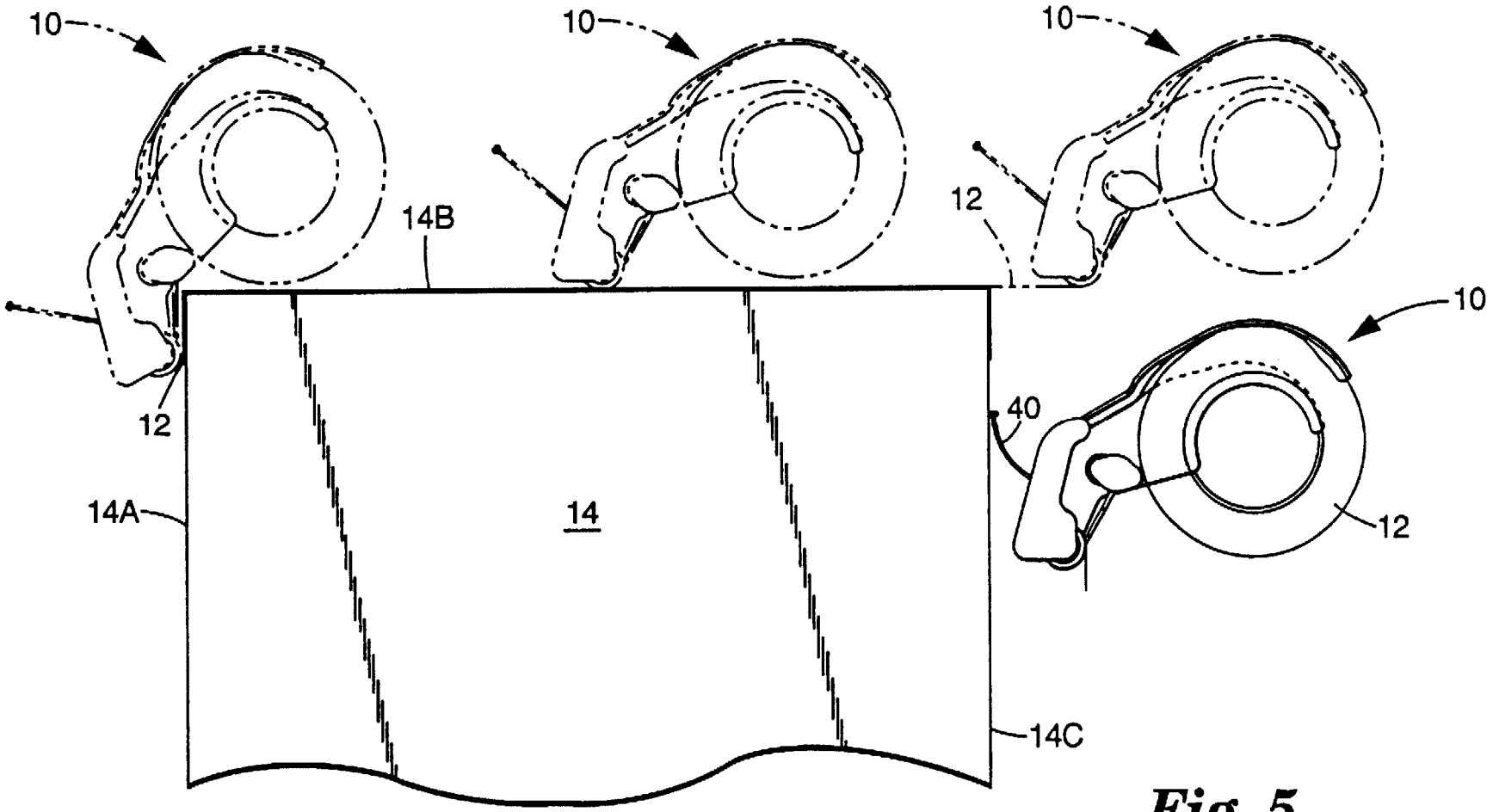
FIG. 5 is a side elevational view of a box and the operational steps for providing a C-clip of tape to a box or carton with the hand tape applicator of the present invention.

As shown in the upper left portion of the drawing of FIG. 5, the hand tape applicator 10 is designed to apply a first portion of tape around a corner of a box without having to turn the device completely around the box corner. Specifically, with the tape roll 12 positioned at or just above the top level of the box 14 adjacent to the box corner, the nose portion 18 is preferably angled so that the application roller 34 extends down the front vertical surface 14A by the entire amount that the tape portion is to be applied to that front vertical surface. Preferably, that amount is about 3 inches for most standard box sizes. However, not only must the nose portion 18 be angled, there must be sufficient space provided between the application roller 34 and the roll of tape 12 so that the box corner can fit within that space. Preferably, the tape holder 62 is also oriented so that it is positioned vertically along the vertical front box surface, which is at about a 45 degree angle from a line connecting the axis of the idler roller 58 to the axis of the tape roll 12.

In a typical operation, the user of the hand tape applicator 10 will grasp the internal surface 30 of the hub 22 with the user's fingers, and will place the users palm and thumb on the outer surface of the brake element 48. In other words, the tape roll 12 will be grasped within the users hand by way of the hub 22 and brake element 48. As shown in FIG. 5, initially, the hand tape applicator 10 will be slightly rotated about the axis of the tape roll 12 so that the nose portion 18 and thus the application roller 34 are extended downwardly. In this orientation, the leading corner of the box 14 fits adequately within the space defined between the application roller 34 and the tape roll 12, as described above. With this slight forward rotation of the hand tape applicator 10, the tape 12 is provided sufficiently downwardly along the front surface 14A of the box 14 to provide the first portion of the C-clip of tape to be applied to the box 14.

A slight rearward rotation of the hand tape applicator 10 thereafter brings the application roller 34 up to the level of the surface of 14B of the box 14 while at the same time applying the first portion of the C-clip of tape to the top portion of box surface 14A. Thereafter, rearward movement of the entire hand tape applicator 10 without any reorientation of the device applies the tape 12 to the box surface 14B to seal the box flaps while the application roller 34 rides along the box surface 14B. The application roller 34, by pressure from the user, sufficiently applies and presses or buffs the tape 12 along the box surface 14B. It is noted at this point, that the user of the hand tape applicator 10 in accordance with the present invention can advantageously control the tension within the tape 12 as it is applied along the entire C-clip of tape by increasing or decreasing the pressure that is applied to the brake element 48 and the hub 22 for squeezing the tape roll 12 therebetween. More specifically, and as described above, it is the friction between the internal surface 26 of the tape core and the external surface 28 of hub 22 and the external surface of the tape 12 against the brake surface 56 that causes the braking action.

Once the entire box surface 14B is taped, continued rearward movement of the hand tape applicator 10 at the same level as the box surface 14B defines the length of tape 12 that will be applied to the upper portion of the box rear surface 14C. Once this length is sufficiently defined, a downward movement of the hand tape applicator 10, while in the same orientation, causes the tape 12 to contact the blade 44 which severs the applied tape 12 from the tape roll and defines the end of the C-clip of tape applied to the box 14C. Moreover, during this downward movement of the hand tape applicator 10, the wiper 40 contacts the remaining portion of the tape 12 to be applied to the top portion of the box surface 14C and presses or buffs the tape 12 against that top portion. Thus, the entire operation of providing a C-clip is defined with minimal reorientation of the hand tape applicator 10 over the entire application process.

It is understood that the hand tape applicator 10 in accordance with the present invention can have many applications beyond that of box sealing applications. However, the specific geometry of the subject device is designed to facilitate the application of tape around a corner of an object with a minimum or device manipulation. The subject device could just as easily apply L-clips of tape to a corner of the box with only minimal additional reorientations.

We claim:

1. A hand-held tape applicator for dispensing and applying a length of tape from a roll of tape to plural perpendicularly arranged sides of an object, said hand-held tape applicator comprising:

a frame comprising a support portion and a nose portion extending from said support portion at an angle;

roll support means provided on said support portion of said frame for rotatably supporting a roll of tape thereon, said roll support means including a gripping surface for a user to hold and manipulate said hand-held tape applicator;

an application roller rotatably supported on said angled nose portion of said frame so that a space will be defined between the application roller and a roll of tape when supported on said roll support means, said space being positioned and of sufficient size so that when a roll of tape is supported on said roll support means and the roll of tape is positioned at one surface of an object, the application roller can be positioned against another surface of the object that is perpendicular to said one surface with a comer of the object within said space, thereby permitting the application of the tape sequentially to said another surface then to said one surface of the object without substantial reorientation of said hand-held tape applicator;

guide means for defining a tape guide path from said roll support means to said application roller along said frame without crossing said space between said application roller and a tape roll, said guide means comprising a guide roller rotatably mounted to said frame at about a transition point between said support portion of said frame and said angled nose portion;

a tape holder connected to said frame by way of a support positioned adjacent to and extending substantially parallel to the axis of said guide roller of said guide means, said tape holder extending toward the periphery of said application roller for positioning tape from the roll of tape against the application roller;

cutting means positioned adjacent to said application roller for cutting the length of tape from the roll after it has been dispensed and applied to an object; and a cap element connected to the distal end of said support and rotatably supporting the distal end of said guide roller.

* * * * *